US007503847B2

(12) United States Patent
Baerlocher

(10) Patent No.: US 7,503,847 B2
(45) Date of Patent: Mar. 17, 2009

(54) GAMING DEVICE HAVING CONVERTIBLE REEL SYMBOLS

(75) Inventor: Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 932 days.

(21) Appl. No.: 10/657,366

(22) Filed: Sep. 8, 2003

(65) Prior Publication Data

US 2005/0054418 A1 Mar. 10, 2005

(51) Int. Cl.
*A63F 9/24* (2006.01)

(52) U.S. Cl. ..... 463/20; 463/16; 273/138.1

(58) Field of Classification Search ..... 463/16; 436/16–22, 25, 30, 31; 273/138.1, 143 R
See application file for complete search history.

(56) References Cited

U.S. PATENT DOCUMENTS

| | | | |
|---|---|---|---|
| 1,564,746 | A | 12/1925 | Barnard |
| 3,977,681 | A | 8/1976 | Deitrich |
| 4,114,890 | A | 9/1978 | Yamamoto et al. |
| 4,171,814 | A | 10/1979 | Tamano |
| 4,651,996 | A | 3/1987 | Watkins, Jr. |
| 4,838,552 | A | 6/1989 | Hagiwara |
| 5,308,065 | A | 5/1994 | Bridgeman et al. |
| 5,332,228 | A | 7/1994 | Schultz |
| 5,393,061 | A | 2/1995 | Manship et al. |
| 5,423,539 | A | 6/1995 | Nagao |
| 5,431,408 | A | 7/1995 | Adams |
| 5,449,173 | A | 9/1995 | Thomas et al. |
| 5,580,053 | A | 12/1996 | Crouch |
| 5,611,535 | A | 3/1997 | Tiberio |
| 5,766,074 | A | 6/1998 | Cannon et al. |
| 5,769,716 | A | 6/1998 | Saffari et al. |
| 5,823,873 | A | 10/1998 | Moody |
| 5,833,536 | A | 11/1998 | Davids et al. |
| 5,833,537 | A | 11/1998 | Barrie |
| 5,927,714 | A | 7/1999 | Kaplan |
| 5,935,002 | A | 8/1999 | Falciglia |
| 5,980,384 | A | 11/1999 | Barrie |

(Continued)

FOREIGN PATENT DOCUMENTS

| | | |
|---|---|---|
| AU | 722969 | 6/1998 |

(Continued)

OTHER PUBLICATIONS

Game Quest Advertisement written by IGT, published 2002.

(Continued)

*Primary Examiner*—Dmitry Suhol
*Assistant Examiner*—Robert Mosser
(74) *Attorney, Agent, or Firm*—Bell, Boyd & Lloyd LLP

(57) ABSTRACT

A gaming device wherein when a certain symbol is displayed on a certain reel in a certain combination of symbols, the symbol is adapted to be changed or modified to at least one other symbol. That is, when at least two flanking symbols are displayed on the reels but the two flanking symbols are separated by at least one convertible symbol, the convertible symbol is changed or modified to a flanking symbol. The player is provided an award, if any, based on the combination of the flanking symbols and the changed convertible symbol.

33 Claims, 9 Drawing Sheets

U.S. PATENT DOCUMENTS

| | | | |
|---|---|---|---|
| 6,056,642 | A | 5/2000 | Bennett |
| 6,059,658 | A | 5/2000 | Mangano et al. |
| 6,089,977 | A | 7/2000 | Bennett |
| 6,093,102 | A | 7/2000 | Bennett |
| 6,120,031 | A | 9/2000 | Adams |
| 6,149,521 | A | 11/2000 | Sanduski |
| 6,159,095 | A | 12/2000 | Frohm et al. |
| 6,174,235 | B1 | 1/2001 | Walker et al. |
| 6,190,254 | B1 | 2/2001 | Bennett |
| 6,220,959 | B1 | 4/2001 | Holmes, Jr. et al. |
| 6,251,013 | B1 | 6/2001 | Bennett |
| 6,299,165 | B1 | 10/2001 | Nagano |
| 6,299,170 | B1 | 10/2001 | Yoseloff |
| 6,302,398 | B1 | 10/2001 | Vecchio |
| 6,311,976 | B1 | 11/2001 | Yoseloff et al. |
| 6,319,124 | B1 | 11/2001 | Baerlocher et al. |
| 6,322,078 | B1 | 11/2001 | Adams |
| 6,358,144 | B1 | 3/2002 | Kaddlic et al. |
| 6,364,766 | B1 | 4/2002 | Anderson et al. |
| 6,398,644 | B1 | 6/2002 | Perrie et al. |
| 6,413,162 | B1 | 7/2002 | Baerlocher et al. |
| 6,416,408 | B2 | 7/2002 | Tracy et al. |
| 6,419,579 | B1 | 7/2002 | Bennett |
| 6,428,412 | B1 | 8/2002 | Anderson et al. |
| 6,439,993 | B1 | 8/2002 | O'Halloran |
| 6,454,266 | B1 | 9/2002 | Breeding et al. |
| 6,494,454 | B2 | 12/2002 | Adams |
| 6,506,114 | B1 | 1/2003 | Estes et al. |
| 6,514,141 | B1 | 2/2003 | Kaminkow et al. |
| 6,517,432 | B1 | 2/2003 | Jaffe |
| 6,551,187 | B1 | 4/2003 | Jaffe |
| 6,561,904 | B2 | 5/2003 | Locke et al. |
| 6,565,433 | B1 | 5/2003 | Baerlocher et al. |
| 6,585,591 | B1 | 7/2003 | Baerlocher et al. |
| 6,604,740 | B1 | 8/2003 | Singer et al. |
| 6,616,142 | B2 | 9/2003 | Adams |
| 6,644,663 | B2 | 11/2003 | Seelig et al. |
| 6,719,630 | B1 | 4/2004 | Seelig et al. |
| 6,731,313 | B1 | 5/2004 | Kaminkow |
| 6,905,406 | B2 | 6/2005 | Kaminkow et al. |
| 7,077,745 | B2 * | 7/2006 | Gomez et al. ..... 463/20 |
| 2002/0068623 | A1 | 6/2002 | Gauselmann |
| 2003/0100356 | A1 | 5/2003 | Brown et al. |
| 2003/0125100 | A1 | 7/2003 | Cannon |
| 2003/0203752 | A1 | 10/2003 | Kaminkow et al. |
| 2003/0203753 | A1 | 10/2003 | Muir et al. |
| 2005/0227754 | A1 | 10/2005 | Kaminkow et al. |

FOREIGN PATENT DOCUMENTS

| | | |
|---|---|---|
| GB | 2 372 617 A | 8/2002 |

OTHER PUBLICATIONS

Othello Website printed Jul. 7, 2003.
Slots 2003 Article written by Strictly Slots, published Jan. 2003.
Windows 2.03 screenshot, printed from www.guidebookgallery.org/screenshots/win203 on Dec. 28, 2006.

* cited by examiner

GAMING DEVICE HAVING CONVERTIBLE REEL SYMBOLS

CROSS-REFERENCE TO RELATED APPLICATIONS

This application is related to the following commonly-owned co-pending patent applications: "GAMING DEVICE HAVING TOUCH ACTIVATED ALTERNATING OR CHANGING SYMBOL," Ser. No. 09/602,331; "GAMING DEVICE HAVING RESULTANT WILD SYMBOLS," Ser. No. 10/191,154, and "GAMING DEVICE HAVING EXTENDER SYMBOLS," Ser. No. 10/191,197.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The games in many existing gaming machines, such as traditional slot machines, are based upon the concept of spinning reels. The player initiates the spin of the reels by making a wager and the positions of the reels after they stop, determines whether a player wins a value and, if so, how much value the player wins. These gaming machines typically have certain features designated for outcomes such as when a player wins a value, advances to a bonus round or when the game terminates. For example, these gaming machines often display the amount of credits earned, flash lights, make sounds or have other features designed to draw attention to the outcome and entertain the player. In one existing game when a predetermined event occurs, a wild symbol replaces various reel symbols, one at a time. If any of those replacements result in a winning combination of symbols, the player wins a certain value. U.S. Pat. No. 6,089,977 entitled, "Slot Machine Game with Roaming Wild Card," discloses a feature generally of this type.

To increase player enjoyment and excitement, it is desirable to provide players with new features for gaming devices which use reels, where the new features involve symbols which change on the reels.

SUMMARY OF THE INVENTION

The present invention relates in general to a gaming device, and more particularly to a gaming device having at least one convertible reel symbol adapted to be converted, changed or modified when flanked, in one embodiment, on adjacent reels by at least two flanking symbols. The gaming device includes a plurality of reels with a plurality of symbols on each of the reels. At least one and preferably a plurality of the symbols on the reels are convertible symbols. A convertible symbol is a symbol that, when displayed on a certain reel in a certain combination of symbols, is adapted to be converted, changed or modified to a different symbol such as a flanking symbol. In one embodiment, the convertible symbol is changed to one of the other symbols in that combination. In another embodiment, the convertible symbol is changed to a related or associated symbol.

At least two and preferably a plurality of the symbols on the reels are flanking symbols. A flanking symbol is a symbol that, when displayed on a certain reel in a certain combination of symbols causes or is adapted to cause a convertible symbol to be converted, changed or modified to a different symbol. In other words, when two flanking symbols flank (i.e., the convertible symbol is between two flanking symbols or is adjacent to each of two flanking symbols), the convertible symbol is converted, changed or modified to a different symbol and in one embodiment, to one of the flanking symbols. Other symbols on the reels are non-convertible symbols which are not adapted to be changed or to cause a convertible symbol to change.

It should be appreciated that the same symbol may exhibit the attributes of either or a function as a flanking symbol or a convertible symbol depending on the combination of symbols displayed in the game. That is, if a symbol functions as a convertible symbol based on the combination of symbols displayed for a first game (i.e., the symbol is flanked between two flanking symbols), the same symbol may function as a flanking symbol based on the combination of symbols displayed for a subsequent or previous game (i.e., the symbol is one of two symbols flanking a convertible symbol.) In other words, depending on the other symbols surrounding a symbol for an individual game play or symbol combination, that symbol may function as either a flanking symbol or a convertible symbol.

In one embodiment, similar to the game Othello™ when one convertible symbol is positioned on one of the paylines of the reels and the convertible symbol is between or flanked on the same payline by two flanking symbols, one on each of the adjacent reels, the convertible symbol is converted, changed or modified to one of the flanking symbols. In another embodiment, when a plurality of convertible symbols are positioned on one of the paylines of the reels and the convertible symbols are between or flanked by two flanking symbols on the same payline, then the plurality of convertible symbols are converted, changed or modified to one of the flanking symbols. It should be appreciated that the paylines may be horizontal, vertical, circular, diagonal, angled or any combination thereof.

The player is provided an award for each, if any, winning combination of symbols on the reels before and after the conversion. That is, the player is provided an award, if any, based on the combination of the unchanged convertible symbol and the flanking symbols. Moreover, the player is provided an award, if any, based on the combination of the changed convertible symbol and the flanking symbols.

For example, in this embodiment, if a first reel displays a flanking symbol, a second reel displays a convertible symbol and a third reel displays a flanking symbol, then the convertible symbol on the second reel is adapted to be changed or modified to a different symbol, in this case one of the flanking symbols. That is, since at least two flanking symbols (i.e., the flanking symbols on the first and third reels) are displayed on a payline of the reels but are separated by at least one convertible symbol (i.e., the convertible symbol on the second reel), the convertible symbol is changed or converted to one of the flanking symbols. An award, if any, is provided to the player based on at least one of the combinations of symbols on the reels.

In one embodiment, the flanking symbols need to be the same flanking symbol in order to modify or change at least one convertible symbol. In another embodiment, the flanking symbols can be different flanking symbols. In an alternative embodiment, one or more flanking symbols are associated with one or more convertible symbols. In this embodiment, a convertible symbol must be between or flanked by two associated flanking symbols on a payline of the reels to be changed or modified. If a convertible symbol is between or flanked by two non-associated flanking symbols on a payline of the reels, the convertible symbol will not be converted, modified or changed. In another embodiment, if a plurality of convertible symbols are flanked by two flanking symbols, then each of the convertible symbols must be the same convertible symbols to be converted, modified or changed. In another embodiment, if a plurality of convertible symbols are flanked by two flanking symbols, then each of the convertible symbols may be different convertible symbols and still be converted modified or changed. In another embodiment, if at least one convertible symbol and at least one non-convertible symbol are each flanked or between two flanking symbols, then the convertible symbol will be converted, changed or modified to a different symbol and the non-convertible symbol will not. In another embodiment, if at least one convertible symbol and at least one non-convertible symbol are each flanked or between two flanking symbols, then neither the convertible symbol or the non-convertible symbol will be converted or changed to different symbols.

In another embodiment, the gaming device or player may pick between at least two convertible symbols to change or modify. That is, if a payline of the reels display two sets or pairs of flanking symbols but each set or pair of flanking symbols is separated by at least one convertible symbol, then the gaming device or player must pick which of the convertible symbols is to be changed or modified. In this embodiment, the order in which the gaming device or player picks the convertible symbols to be converted, changed or modified directly effects the award provided to the player. In this embodiment, a symbol may be either a convertible symbol or a flanking symbol depending on which convertible symbol is picked to convert, change or modify. That is, a symbol may be a flanking/convertible symbol that is capable of operating either as a flanking symbol, as a convertible symbol or as both.

For example, if the first reel displays a flanking symbol, the second reel displays a flanking/convertible symbol, the third reel displays a flanking/convertible symbol and the fourth reel displays a flanking symbol, then the gaming device or player must pick how each of the flanking/convertible symbols will operate. In other words, the gaming device or player must pick which of the two flanking/convertible symbols to change or modify (i.e., to exhibit the properties of a convertible symbol). That is, in for one displayed combination a symbol may function as a flanking symbol and in another displayed combination, the same symbol may function as a convertible symbol. In this embodiment, if the flanking/convertible symbol on the second reel is picked or designated to be changed or modified, then the flanking/convertible symbol on the third reel will be designated as a flanking symbol. In this case, since the designated convertible symbol on the second reel is between or flanked by the flanking symbol on the first reel and the designated flanking symbol on the third reel, then the designated convertible symbol on the second reel is adapted to be converted, changed or modified to a different symbol. On the other hand, if the flanking/convertible symbol on the third reel is picked or designated to be converted, changed or modified, then the flanking/convertible symbol on the second reel will be designated as a flanking symbol. In this case, since the designated convertible symbol on the third reel is between or flanked by the designated flanking symbol on the second reel and the flanking symbol on the fourth reel, then the designated convertible symbol is adapted to be converted, changed or modified to a different symbol. In this embodiment, depending on which flanking/convertible symbol is selected to be converted, modified or changed, an award, if any, is provided to the player based on each of the displayed symbol combinations. It should be appreciated that as the awards will differ according to what symbol combination is displayed, the pick of which convertible symbol to convert, change or modify will effect the award provided to the player.

In another embodiment wherein at least two sets or pairs of flanking symbols are each separated by at least one convertible symbol, the combination of symbols displayed after a first convertible symbol is changed or converted may be subsequently changed or converted to produce another combination of symbols. That is, the gaming device or player may sequentially change one or more than one of the convertible symbols to form one or more than one combinations of symbols. In one embodiment, the player is provided an award, if any, for one of the formed combination of symbols, such as the final displayed combination. In another embodiment, the player is provided an award, if any, for each formed combination of symbols. In this embodiment, the sequence in which the convertible symbols are changed or modified effects the awards, if any, provided to the player.

The gaming device of the present invention increases player enjoyment and excitement by providing players with new reel features wherein the new features involve symbols which change on the reels when flanked by at least two flanking symbols.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Figure 1A:
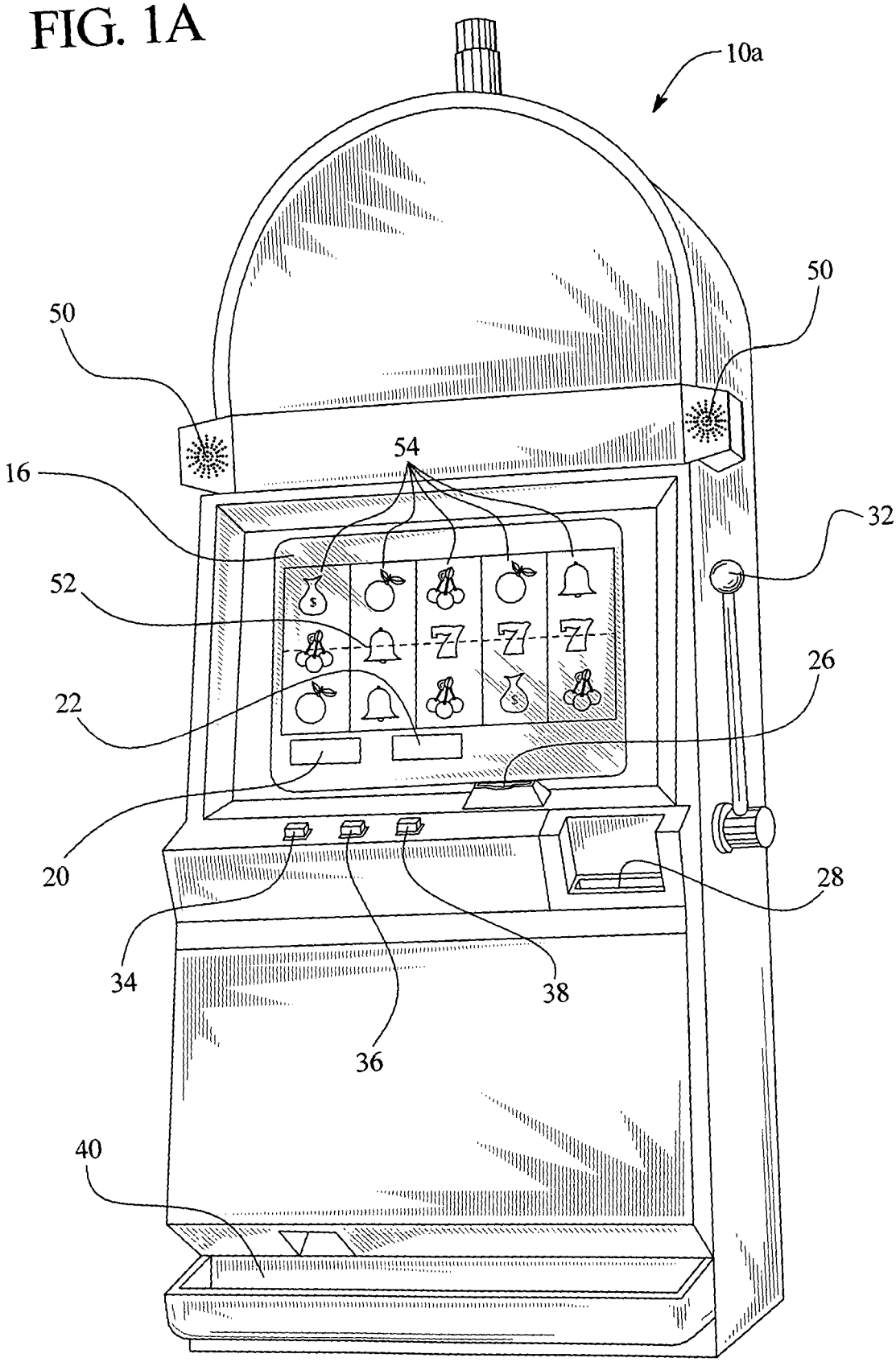
FIG. 1A is a front-side perspective view of one embodiment of the gaming device of the present invention.
Figure 1B:
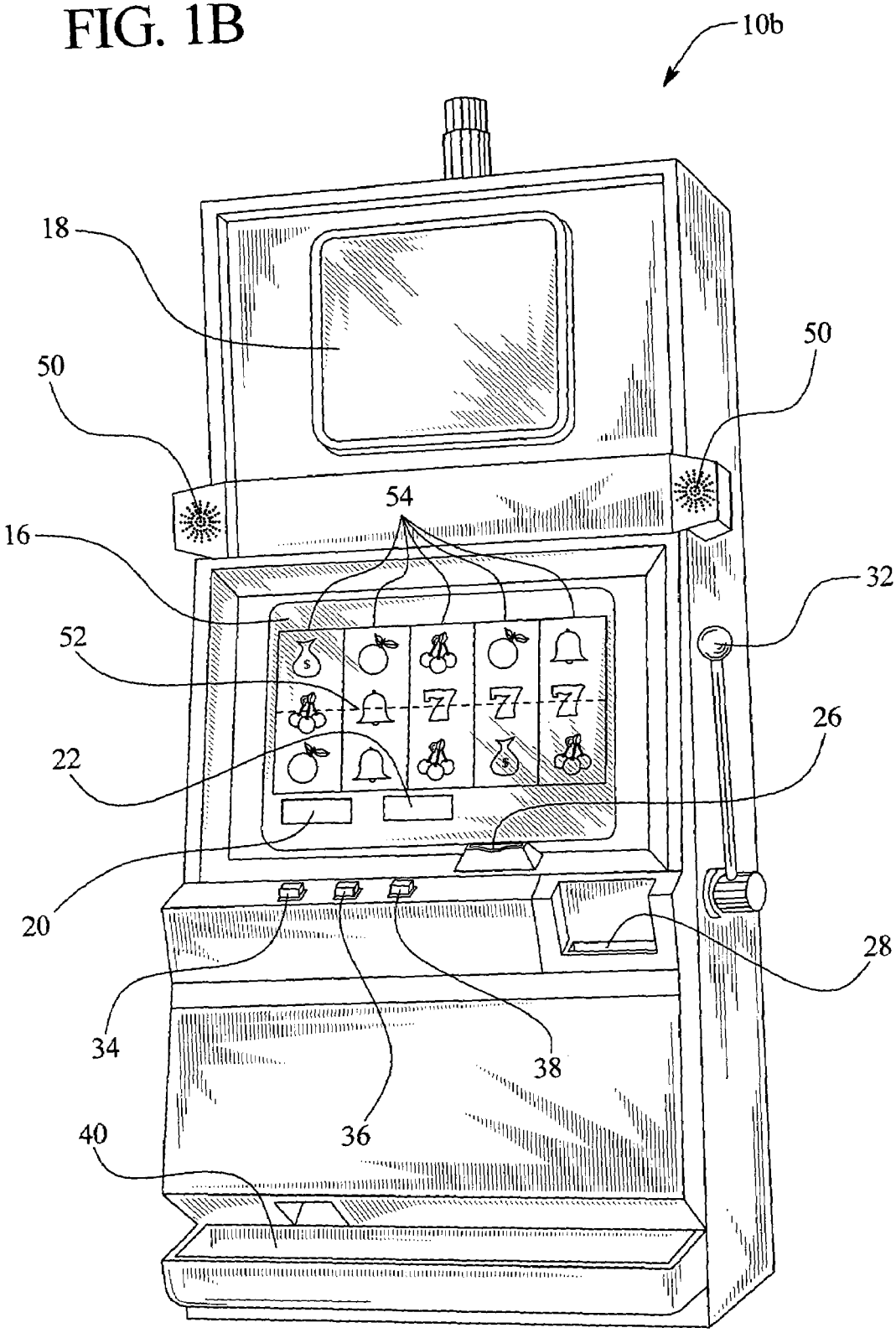
FIG. 1B is a front-side perspective view of another embodiment of the gaming device of the present invention.

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 2A:
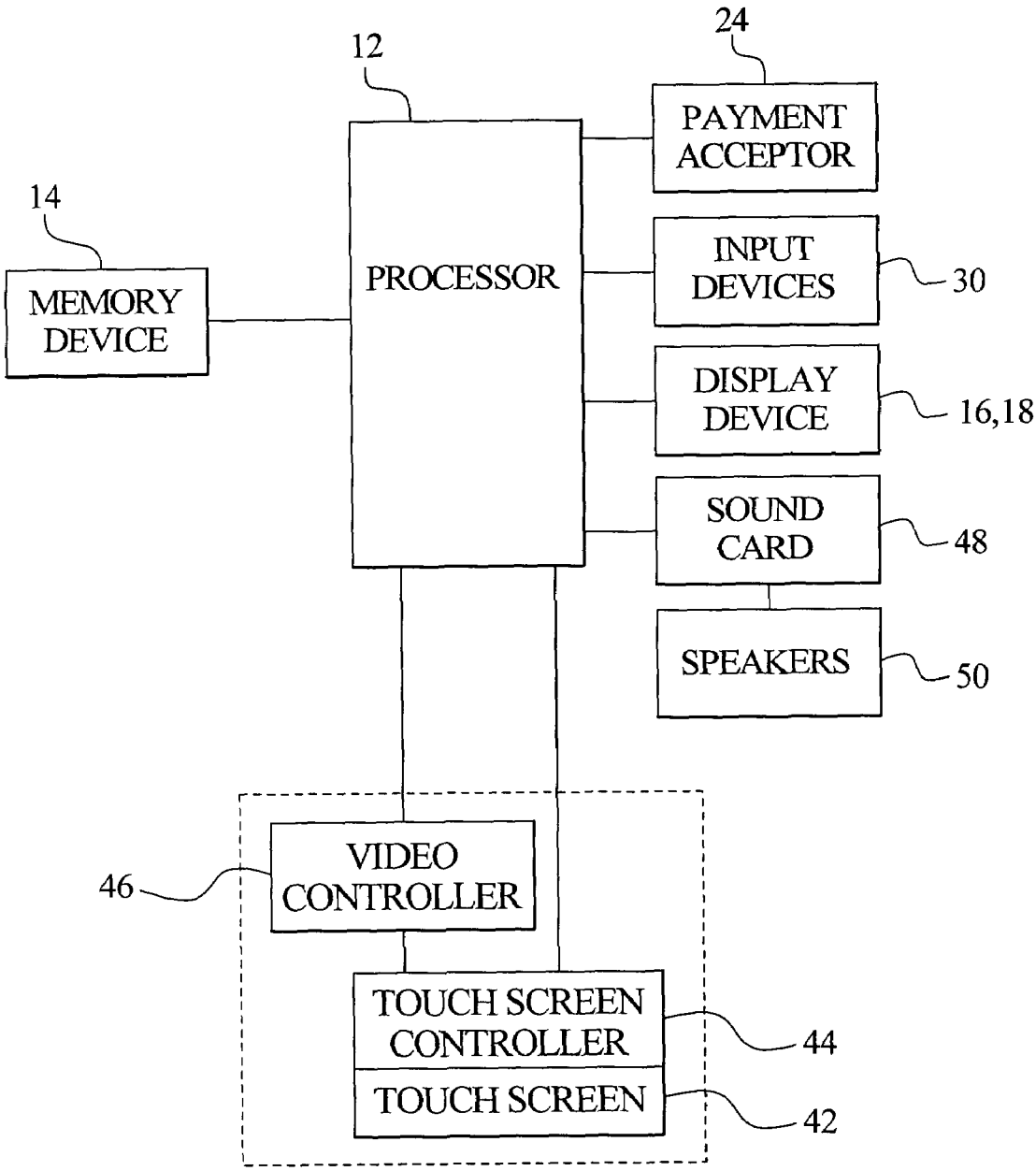
FIG. 2A is a schematic block diagram of the electronic configuration of one embodiment of the gaming device of the present invention.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM). In one embodiment, the memory device includes read only memory (ROM). In one embodiment, the memory device includes flash memory and/or EEPROM (electrically erasable programmable read only memory). Any other suitable magnetic, optical and/or semiconductor memory may be implemented in conjunction with the gaming device of the present invention.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. As seen in FIGS. 1A and 1B, in one embodiment, gaming device includes a credit display 20 which displays a player's current number of credits, cash, account balance or the equivalent. In one embodiment, gaming device includes a bet display 22 which displays a player's amount wagered.

The display devices may include, without limitation, a monitor, a television display, a plasma display, a liquid crystal display (LCD) a display based on light emitting diodes (LED) or any other suitable electronic device or display mechanism. In one embodiment, as described in more detail below, the display device includes a touch-screen with an associated touch-screen controller. The display devices may be of any suitable configuration, such as a square, rectangle, elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, tournament advertisements and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one and preferably a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

Figure 2B:
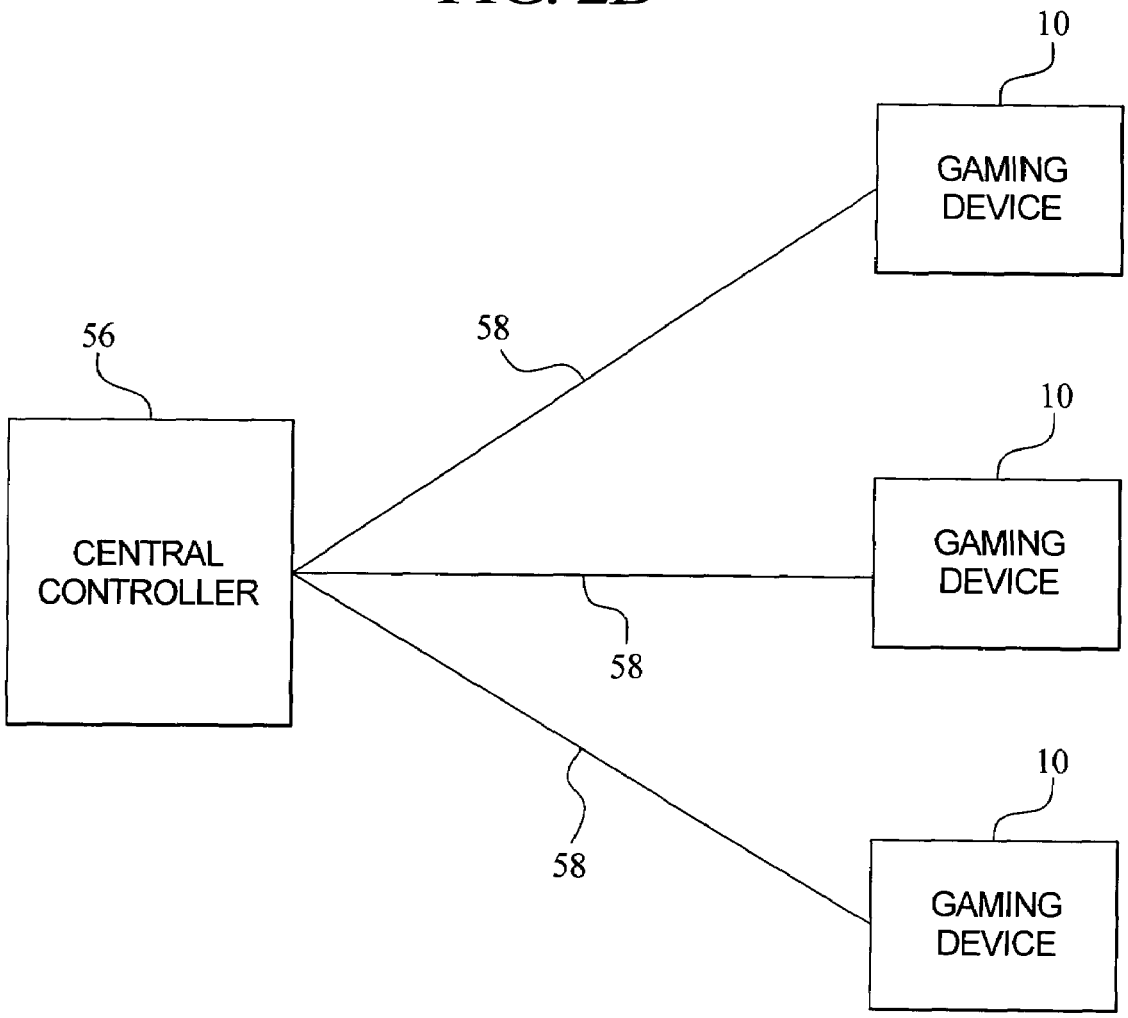
FIG. 2B is a schematic block diagram illustrating a plurality of gaming terminals in communication with a central controller.

In one embodiment, as illustrated in FIG. 2B, one or more of the gaming devices 10 of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital signal line (DSL), T-1 line, coaxial cable, fiber optic cable, or other suitable connection. In this embodiment, players may access an Internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

The reel or slot game of the present invention can be provided to the player as a primary or base game or as a secondary or bonus game. If the reel or slot game is provided as a secondary game, then the gaming device can incorporate any suitable wagering primary or base game. The gaming machine or device of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation from a wager. That is, different primary wagering games, such as video poker games, video blackjack games, video Keno, video bingo or any other suitable primary or base game may be implemented into the present invention.

In one embodiment, a base or primary game may be a poker game wherein the gaming device enables the player to play a conventional game of video poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and replacement cards are dealt from the remaining cards in the deck. This results in a final five-card hand. The final five-card hand is compared to a payout table which utilizes conventional poker hand rankings to determine the winning hands. The player is provided with an award based on a winning hand and the credits the player wagered.

In another embodiment, the base or primary game may be a multi-hand version of video poker. In this embodiment, the player is dealt at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

If the reel game of the present invention is incorporated as a primary or base game, then in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game; he must win or earn entry through play of the primary game and, thus, play of the primary game is encouraged. In another embodiment, qualification of the bonus or secondary game could be accomplished through a simple "buy in" by the player if, for example, the player has been unsuccessful at qualifying through other specified activities.

Regardless of if the reel or slot game of the present invention is incorporated as a primary or base game or as a secondary or bonus game, the reel or slot game includes one or more paylines 52 as illustrated in FIGS. 1A and 1B. The paylines may be horizontal, vertical, circular, diagonal, angled or any combination thereof. In one embodiment, the gaming device displays at least one and preferably a plurality of reels 54, such as three to five reels 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In one embodiment, if the reels 54 are in video form, the plurality of simulated video reels 54 are displayed on one or more of the display devices as described above. Each reel 54 displays a plurality of indicia or symbols such as bells, hearts, fruits, numbers, letters, bars or other images which preferably correspond to a theme associated with the gaming device.

Flanking and Convertible Symbols

Figure 3A:
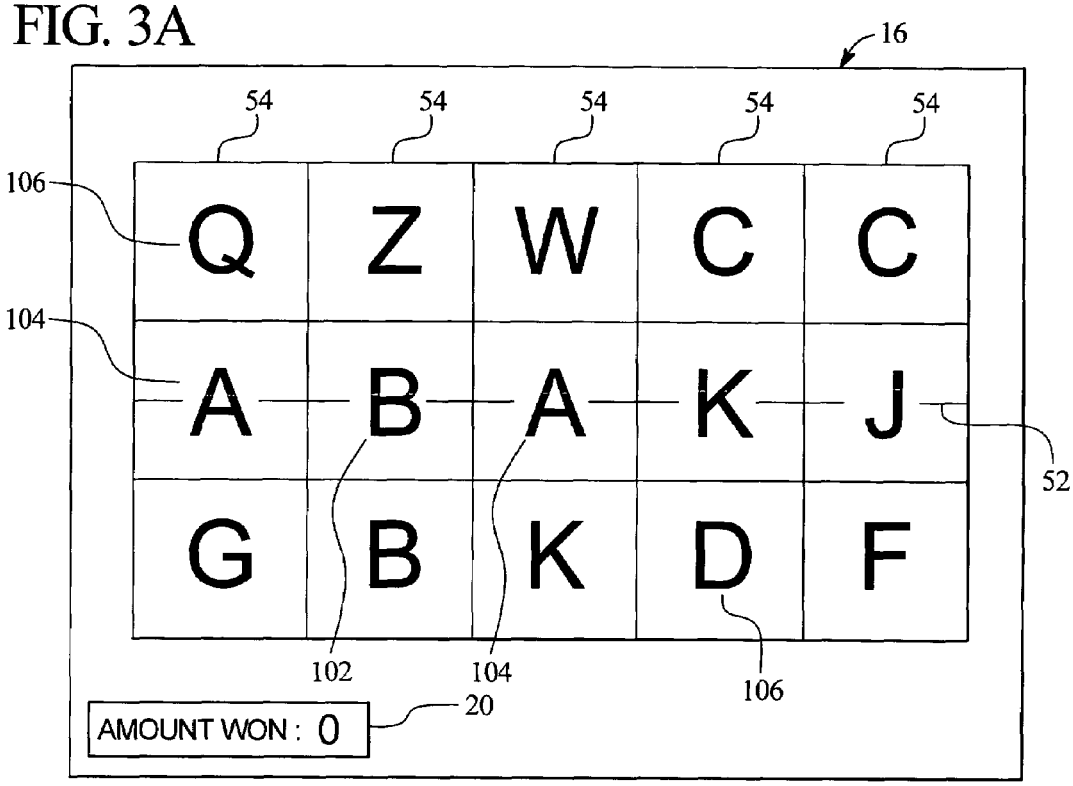
FIGS. 3A and 3B are front elevational views of one embodiment of the present invention illustrating a change of a convertible symbol on the reels of the gaming device.

Referring now to FIG. 3A, at least one and preferably a plurality of the symbols on the reels are convertible symbols 102 illustrated as the letter "B" on the center payline 52 of the second reel. In one embodiment, the number of convertible symbols on the reels is based on the player's wager (or a component of the wager), a triggering event or other predetermined or randomly determined occurrence. In another embodiment, the location of each convertible symbol on the reels is based on the player's wager (or a component of the wager), a triggering event or other predetermined or randomly determined occurrence. At least two and preferable a plurality of symbols on the reels are flanking symbols 104 illustrated as the letter "A" on the first reel and the third reel. In one embodiment, the number of flanking symbols on the reels is based on the player's wager (or a component of the wager), a triggering event or other predetermined or randomly determined occurrence. In another embodiment, the location of each flanking symbol on the reels is based on the player's wager (or a component of the wager), a triggering event or other predetermined or randomly determined occurrence. Other symbols 106 are also generated and displayed on the reels. As displayed in the credit display 20, an award is not provided to the player based on this initial combination of symbols.

Figure 3B:
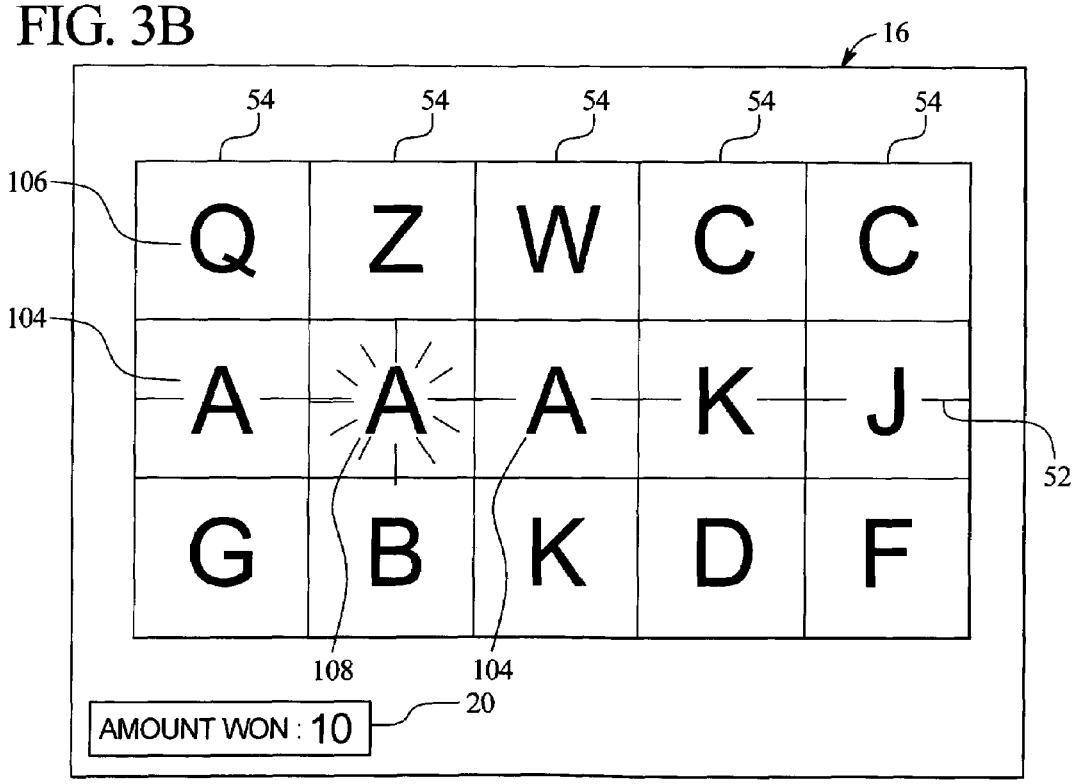

As illustrated in FIG. 3B, since two flanking symbols were separated by a convertible symbol, the convertible symbol is modified or converted to the flanking symbol as illustrated as the letter "A" 108 on the second reel. As displayed in the credit display 20, an award of ten is provided to the player based on this winning combination of symbols on the reels. The modification of the convertible symbol to the flanking symbol may be animated as, but not limited to, symbols moving in any direction, simulating actual movement, operation or behavior, bending, transforming into a different shape or size, separating into different parts, expanding or contracting, changing colors, shades or patterns, illuminating, making sounds or otherwise having dynamic characteristics.

It should be appreciated that the same symbol may exhibit the attributes of or function as either a flanking symbol or a convertible symbol depending on the combination of symbols displayed for each game play. That is, if a symbol functions as a convertible symbol based on the combination of symbols displayed for a first game (i.e., the symbol is flanked between two flanking symbols), the same symbol may function as a flanking symbol based on the combination of symbols displayed for a previous or subsequent game (i.e., the symbol is one of two symbols flanking a convertible symbol.) In other words, depending on the other symbols surrounding a symbol for an individual game play or symbol combination, each symbol may function as either a flanking symbol or a convertible symbol for each play of the game.

In one embodiment, the flanking symbols need to be the same flanking symbol in order to modify or change at least one convertible symbol. In another embodiment, the flanking symbols can be different flanking symbols. In an alternative embodiment, one or more flanking symbols are associated with one or more convertible symbols. In this embodiment, a convertible symbol must be between or flanked by two associated flanking symbols on a payline of the reels to be changed or modified. If a convertible symbol is between or flanked by two non-associated flanking symbols on a payline of the reels, the convertible symbol will not be modified or changed. In another embodiment, if a plurality of convertible symbols are flanked by two flanking symbols, then each of the convertible symbols must be the same convertible symbols to be modified or changed. In another embodiment, if a plurality of convertible symbols are flanked by two flanking symbols, then each of the convertible symbols may be different convertible symbols and still be modified or changed. In another embodiment, if at least one convertible symbol and at least one non-convertible symbol are each flanked or between two flanking symbols, then the convertible symbol will be changed or modified to a different symbol and the non-convertible symbol will not. In another embodiment, if at least one convertible symbol and at least one non-convertible symbol are each flanked or between two flanking symbols, then neither the convertible symbol or the non-convertible symbol will be changed to different symbols.

Figure 4A:
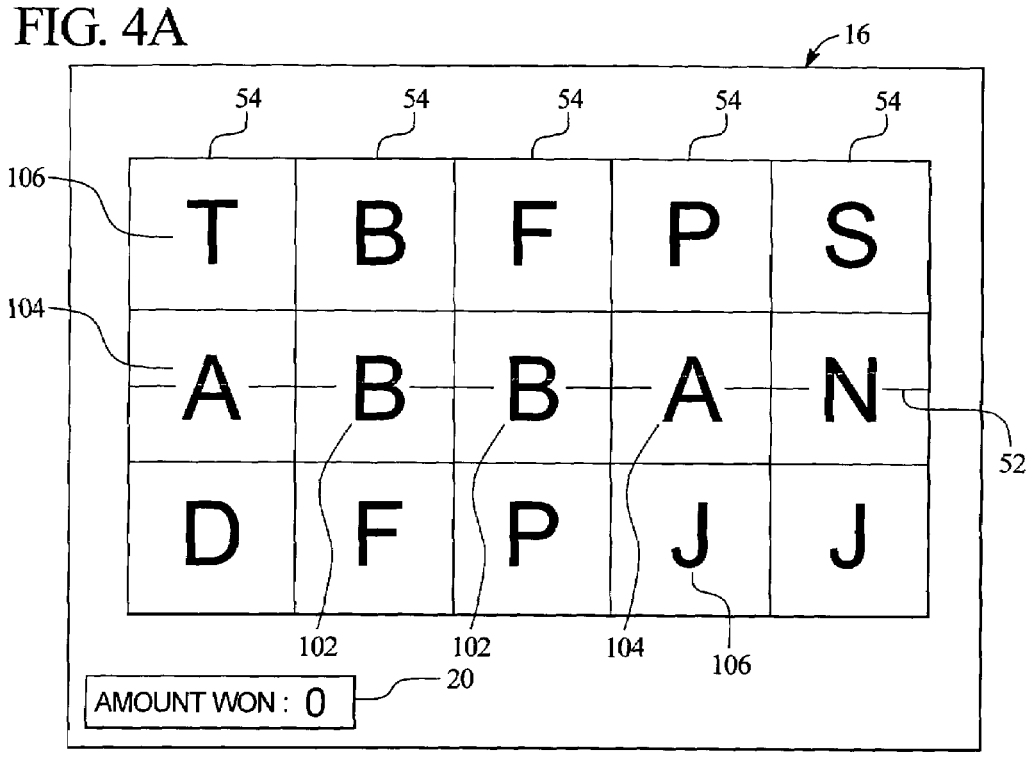
FIGS. 4A and 4B are front elevational views of an alternative embodiment of the present invention illustrating the change of a plurality of convertible symbols on the reels of the gaming device.
Figure 4B:
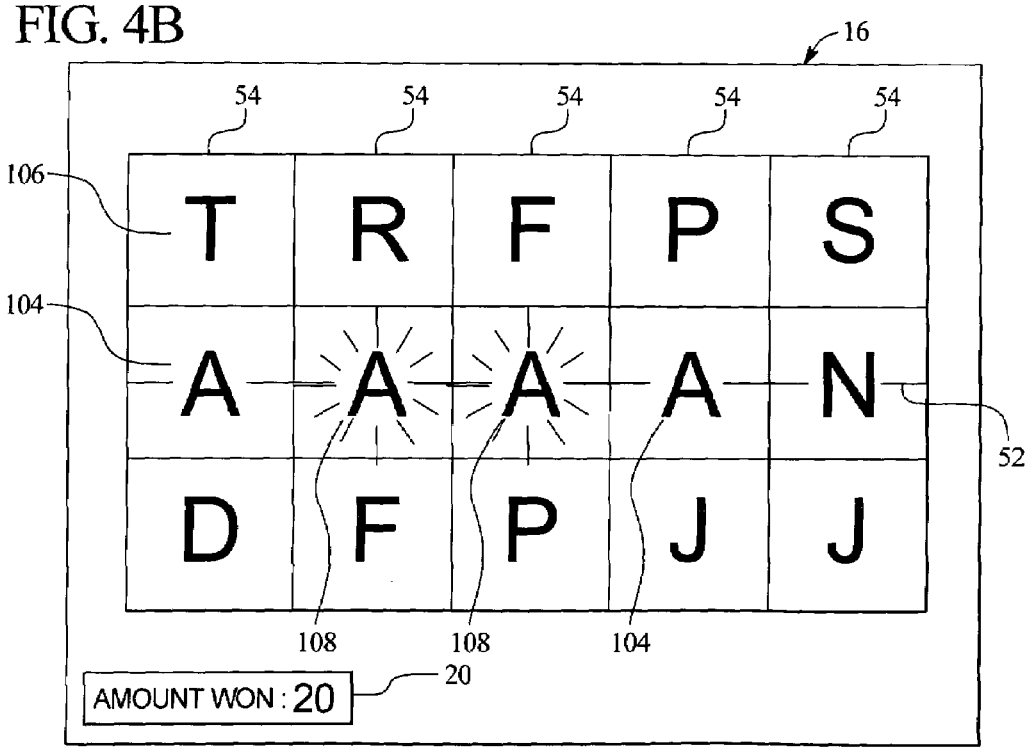

In FIG. 4A, if two flanking symbols 104 illustrated as the letter "A" occur on the same payline 52 of the reels 54 but are separated by a plurality of convertible symbols 102 illustrated as the letter "B", then each of the plurality of convertible symbols is adapted to be converted, modified or changed to a different symbol. As seen in FIG. 4B, each of the plurality of convertible symbols is modified or converted to the flanking symbol 108 illustrated as the highlighted letter "A" and the credit display 20 display that an award of twenty is provided to the player based on this winning combination of symbols on the reels.

In this embodiment, regardless of if the convertible symbols are the same convertible symbol or different convertible symbols, they will be changed or converted to the flanking symbol. That is, in this embodiment, even if the two flanking symbols were separated by two different convertible symbols, the gaming device would still modify or convert both the different convertible symbols to the flanking symbol.

In one embodiment, the same symbol may function as both a flanking symbol and a convertible symbol during different sequences of the same game play. In other words, one or more of the symbols may be adapted to exhibit the attributes of either a flanking symbol and/or a convertible symbol depending on the combination of symbols displayed during the game sequence of one game play. That is, these flanking/convertible symbols may be designated or function as a flanking symbols in one game play sequence for one symbol combination and in a subsequent play sequence of the same game play, the same flanking/convertible symbol may be designated or function as a convertible symbol for another symbol combination. In other words, during one game sequence, the same symbol may function as both a flanking symbol for one displayed symbol combination and a convertible symbol for another displayed symbol combination.

Figure 5A:
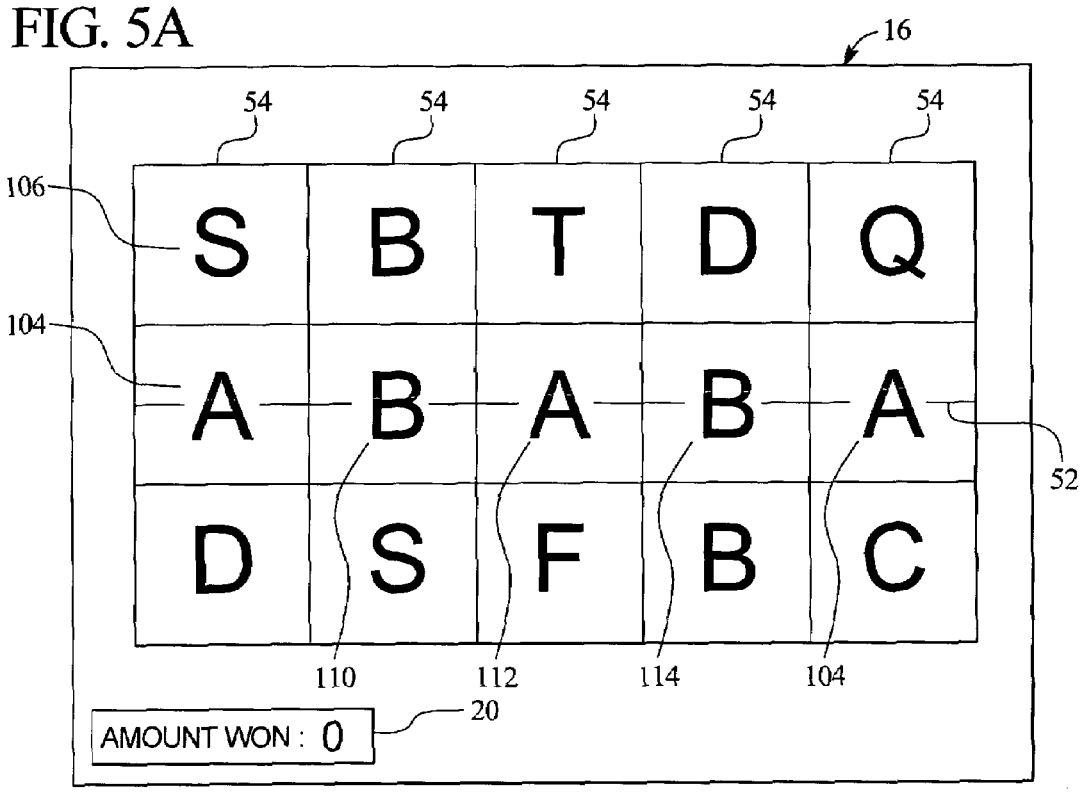
FIGS. 5A, 5B and 5C are front elevational views of another embodiment of the present invention illustrating a plurality of changes of a plurality of convertible symbols on the reels of the gaming device.
Figure 5B:
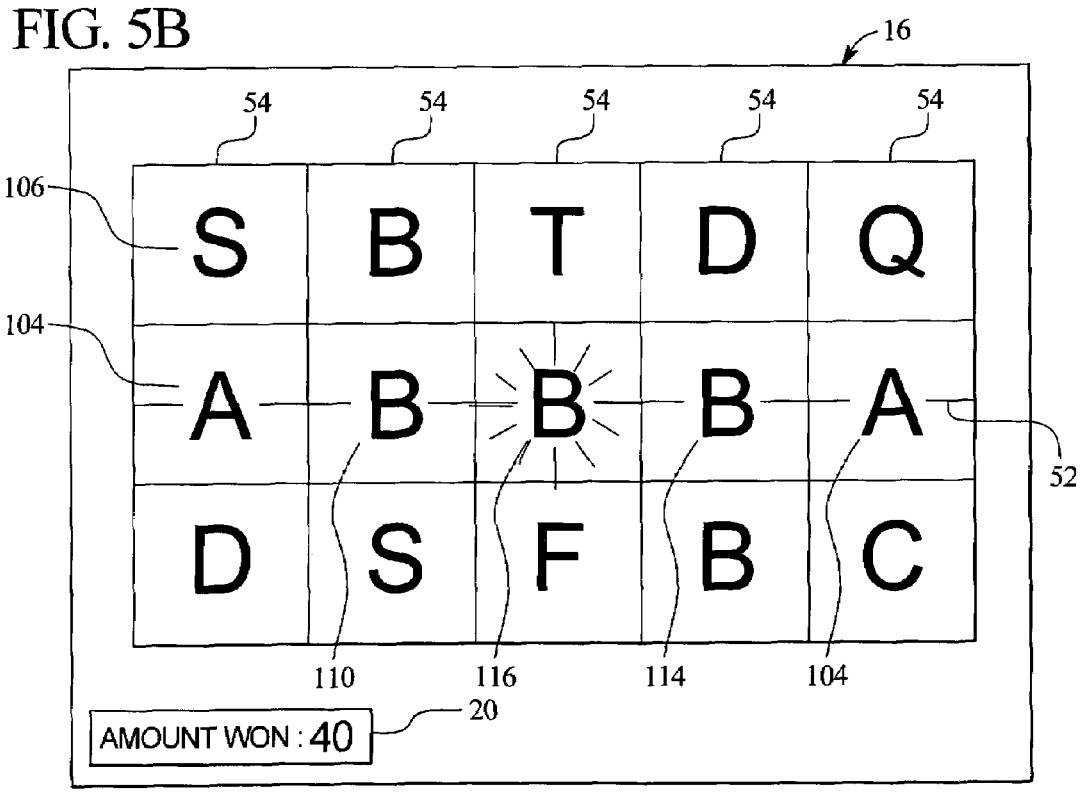
Figure 5C:
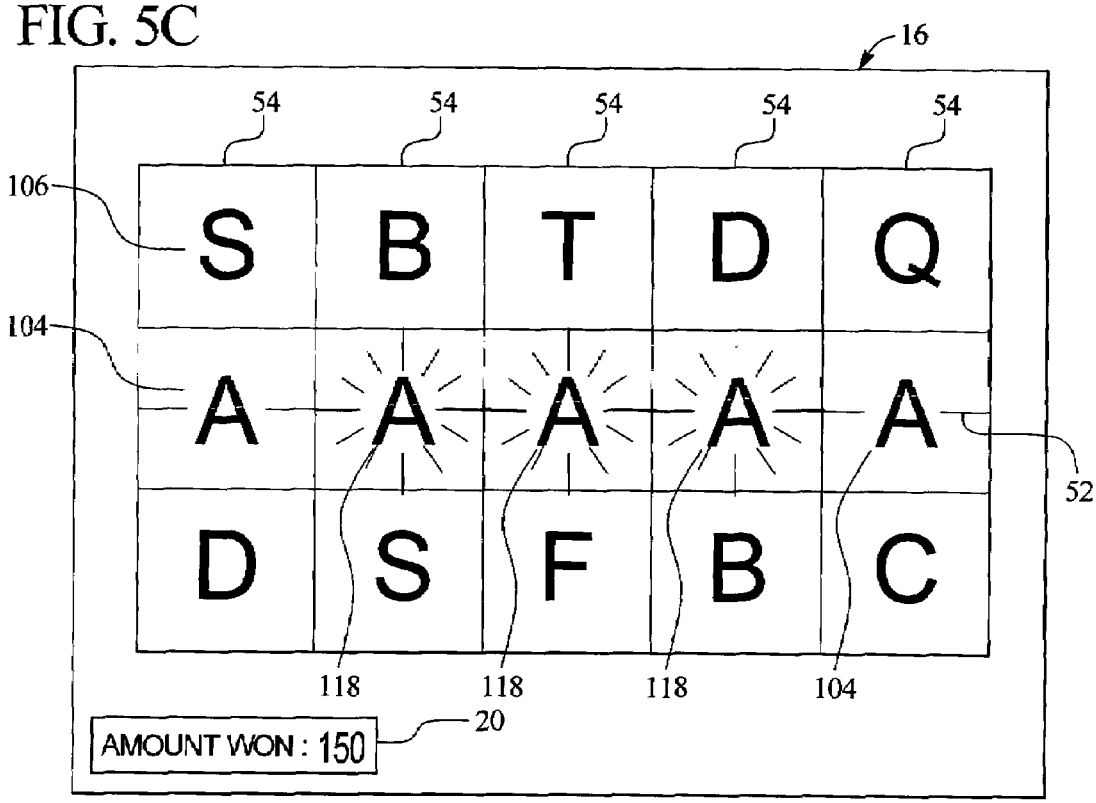

Referring to FIGS. 5A to 5C, in another embodiment, the gaming device is operable to change at least one convertible symbol that separates at least two flanking symbols as described above and then subsequently change at least one other convertible symbol that separates two different flanking symbols. In this embodiment, at least one of said symbols is a flanking/convertible symbol which, as described above, is adapted to exhibit the attributes of either flanking symbols, convertible symbols or both during subsequent game play sequences of the same game play. As seen in FIG. 5A, across the center payline 52 of the reels 54, the first reel displays a flanking symbol 104 illustrated as letter "A", the second reel displays a flanking/convertible symbol 110 illustrated as letter "B", the third reel displays a flanking/convertible symbol 112 illustrated as letter "A", the fourth reel displays a flanking/convertible symbol 114 illustrated as letter "B" and the fifth reel displays a flanking symbol 104 illustrated as letter "A". As displayed in the credit display 20, an award is not provided to the player based on this initial combination of symbols.

As described above and seen in FIGS. 5A and 5B, the two flanking/convertible symbols illustrated as the letter "B" on the second and fourth reels 110 and 114, respectively, may be designated as flanking symbols and the flanking/convertible symbol illustrated as the letter "A" on the third reel 112 may be designated a convertible symbol. In this embodiment, the designated convertible symbol is changed or converted to the designated flanking symbol 116 illustrated as the highlighted letter "B" in FIG. 5B. In this embodiment, as seen in the credit display 20, an award of forty is provided to the player based on this winning combination of symbols on the reels (i.e., the letter "B" on the second, third and fourth reels.) In one embodiment, the player designates which attribute each flanking/convertible symbol will exhibit for each play sequence. In another embodiment, the gaming device designates which attribute each flanking/convertible symbol will exhibit for each play sequence.

As illustrated in FIGS. 5B and 5C, since a plurality of the flanking/convertible symbols 110, 116 and 114 of this new combination of symbols are adapted to be changed or converted, the gaming device or player may subsequently redesignate each of the previously designated flanking/convertible symbols as convertible symbols and change the designated convertible symbols to different symbols. As seen in FIG. 5C, since the flanking symbols 104 on the first and fifth reel are separated by the redesignated convertible symbols on the second, third and fourth reels 110, 116 and 114 respectively, the redesignated convertible symbols will be changed to different symbols, in this case, the flanking symbols. As illustrated in FIG. 5C, the changed symbols 118 are illustrated as the highlighted letter "A". In this embodiment, an award of one-hundred ten is provided to the player based on this winning combination of symbols on the reels (i.e., the same "A" symbol being on all five reels.) Accordingly, credit display 20 displays an award amount of one-hundred fifty which represents the award of one-hundred ten for this winning symbol combination and the award of forty from the previous winning symbol combination. In one embodiment, the player is provided an award for each formed winning combination of symbols. In another embodiment, the player is provided an award for one of the formed winning combination of symbols, such as the final displayed winning combination.

In this embodiment, the order in which the symbols on the reels are changed or modified directly effects the award provided to the player. That is, had the flanking/convertible symbols on the second, third and fourth reels 110, 112 and 114 respectively, been first designated as convertible symbols and directly modified or changed to one of the flanking symbols, without the intermediate sequence seen in FIG. 5B, the player would have still obtained an award of one-hundred ten for that winning symbol combination (i.e., the same "A" symbol displayed on all five reels), but unlike as described above, the player would not have obtained an award of forty for the intermediate winning symbol combination (i.e., the same "B" symbol displayed on the second, third and fourth reels.)

As described above, the awards will differ according to what symbol combination is displayed and thus the pick of which convertible symbol to change or modify will effect the award, if any, provided to the player. In one embodiment, the gaming device automatically proceeds in changing symbols so that the player is provided the maximum award. In another embodiment, the gaming device proceeds in changing symbols so that the player is provided the minimum award. In an alternative embodiment, the gaming device randomly selects which symbols to change first. In another embodiment, the player is enabled to select which symbols to change first. In this embodiment, the player must use an appropriate strategy to maximize their awards.

Figure 6A:
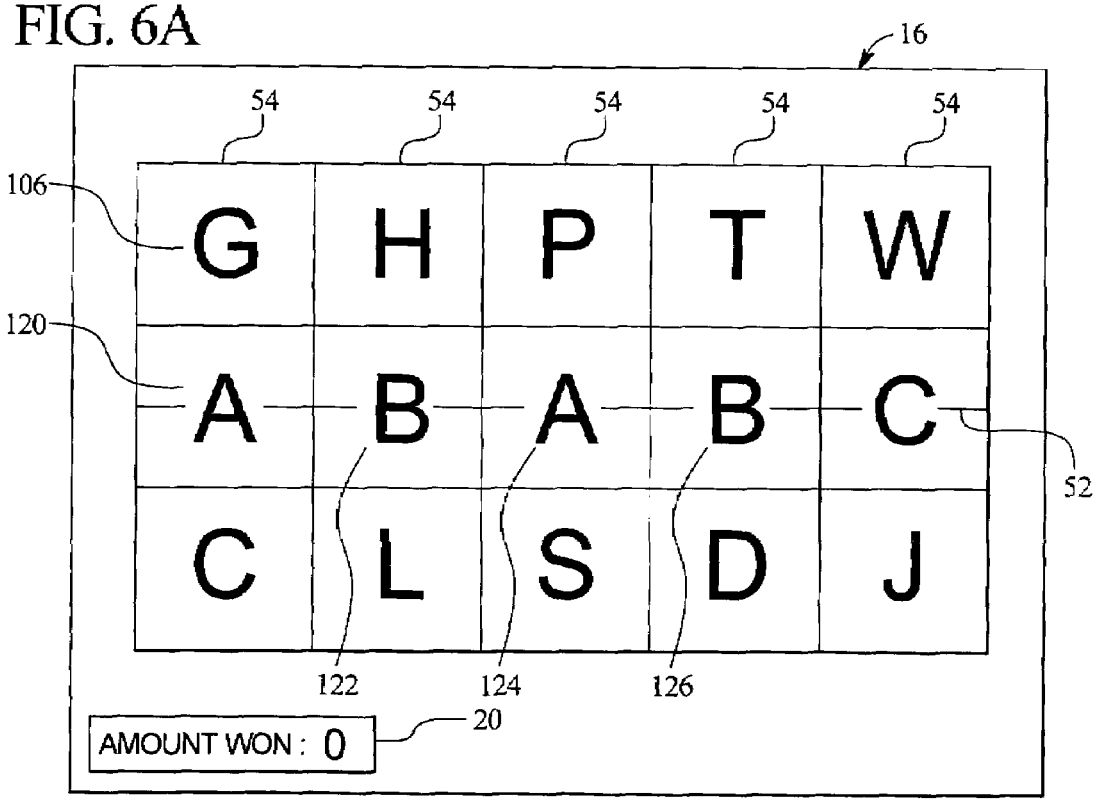
FIGS. 6A, 6B and 6C are front elevational views of another alternative embodiment of the present invention illustrating the change of at least one convertible symbol on the reels of the gaming device.
Figure 6B:
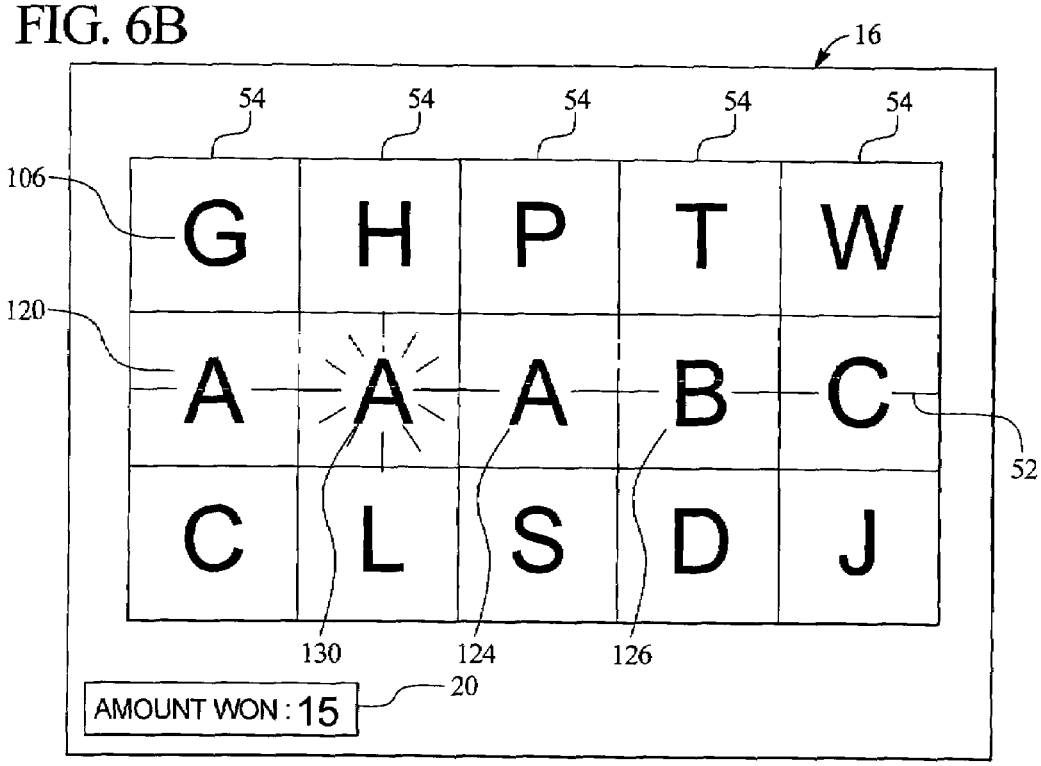
Figure 6C:
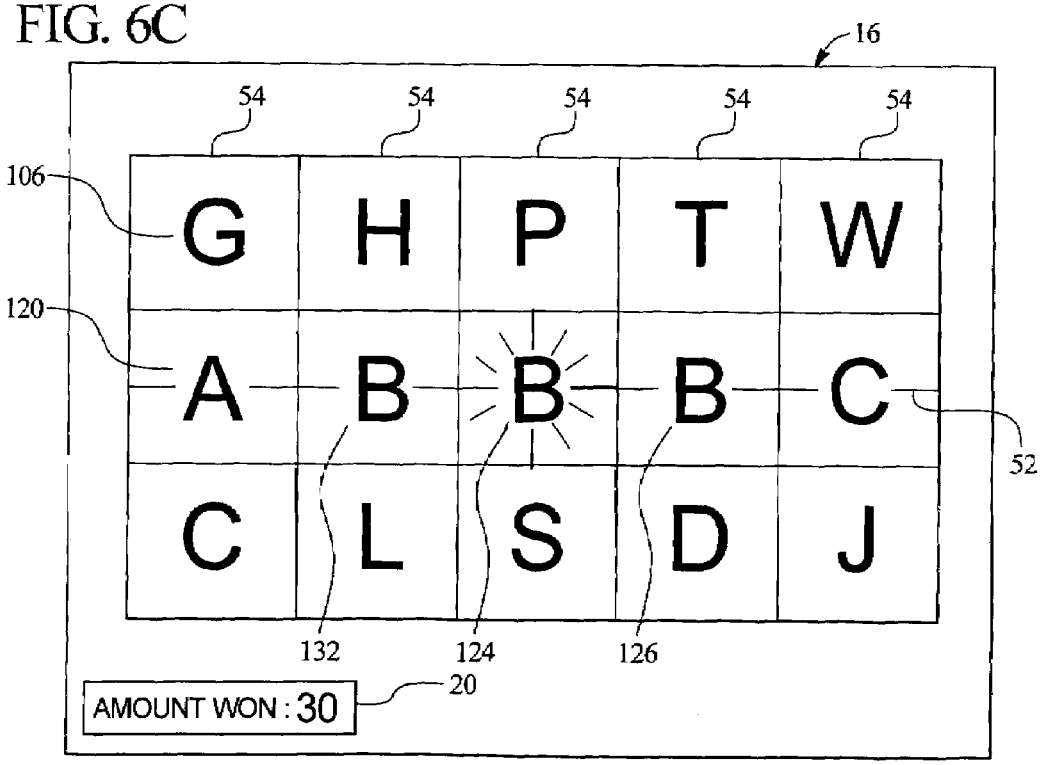

In another embodiment, illustrated in FIGS. 6A to 6C, the gaming device or player may pick between at least two convertible symbols to change or modify. That is, if a payline of the reels display two sets or pairs of flanking symbols (or a flanking/convertible symbol that is designated a flanking symbol) but each set or pair of flanking symbols is separated by at least one convertible symbol (or a flanking/convertible symbol that is designated a convertible symbol), then the gaming device or player must pick which of the convertible symbols is to be changed or modified. In this embodiment, the symbols which the gaming device or player pick to be changed or modified directly effects the award provided to the player.

As illustrated in FIGS. 6A and 6B, if the first reel displays a flanking symbol 120 illustrated as letter "A", the second reel displays a flanking/convertible symbol 122 illustrated as letter "B", the third reel displays a flanking/convertible symbol 124 illustrated as letter "A" and the fourth reel displays a flanking symbol 126 illustrated as letter "B", then the gaming device or player must pick which of the two flanking/convertible symbols to change or modify. In this embodiment, as described above, the flanking/convertible 122 on the second reel and the flanking/convertible 124 on the third reel are each capable of being either flanking symbols or convertible symbols depending on which convertible symbol is picked to be changed or modified. That is, if the flanking/convertible symbol 122 on the second reel is picked to be changed or modified, then the flanking/convertible symbol 124 on the third reel may be designated as a flanking symbol. In this case, as illustrated in FIG. 6B, since the designated convertible symbol 122 on the second reel is between or flanked by the flanking symbol 120 on the first reel and the designated flanking symbol 124 on the third reel, then the designated convertible symbol on the second reel is changed or modified to a different symbol, in this case illustrated as highlighted letter "A" 130. As seen in the credit display 20, an award of fifteen is provided to the player based on this winning combination of symbols on the reels (i.e., the same "A" symbol on the first, second and third reels.)

On the other hand, as illustrated in FIGS. 6A and 6C, if the flanking/convertible symbol 124 on the third reel is picked to be changed or modified, then the flanking/convertible symbol 122 on the second reel will be designated as a flanking symbol. In this case, as illustrated in FIG. 6C, since the designated convertible symbol 124 on the third reel is between or flanked by the designated flanking symbol 122 on the second reel and the flanking symbol 126 on the fourth reel, then the designated convertible symbol on the third reel is changed or modified to a different symbol, in this case illustrated as highlighted letter "B" 132. As seen in the credit display 20, an award of thirty is provided to the player based on this winning combination of symbols on the reels (i.e., the same "B" symbol on the second, third and fourth reels.)

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a display device configured to display a plurality of reels and a plurality of symbols on said reels, wherein at least two of said symbols are non-convertible flanking symbols, at least one of said symbols is a convertible symbol, at least one of said symbols is a flanking-convertible symbol, and at least one of said symbols is a non-convertible symbol, wherein said at least two non-convertible flanking symbols, said at least one convertible symbol, said at least one flanking-convertible symbol and said at least one non-convertible symbol are visually distinct from one another; and a processor configured to operate with the display device, for a single play of a game, to:

(a) cause a generation and display of at least one of said symbols on each of the reels;

(b) change said convertible symbol to one of said non-convertible flanking symbols and cause a display of said change if said convertible symbol is generated on an active payline associated with one of said reels which is directly between two non-convertible flanking symbols generated on said active payline associated with two of said reels;

(c) if said flanking-convertible symbol is generated on the active payline associated with one of said reels which is directly between two non-convertible flanking symbols generated on said active payline associated with two of said reels, designate said flanking-convertible symbol as one of said convertible symbols, change said convertible symbol to one of said non-convertible flanking symbols, and cause a display of said change;

(d) if said flanking-convertible symbol is generated on the active payline associated with one of said reels which directly flanks one of the at least one convertible symbols generated on said active payline associated with one of said reels, and said convertible symbol is additionally flanked by one of said non-convertible flanking symbols, designate said flanking-convertible symbol as one of said non-convertible flanking symbols, change said designated convertible symbol to one of said non-convertible flanking symbols, and cause a display of said change;

(e) provide a player an award based on any winning combination of symbols on the reels;

(f) if said non-convertible symbol is generated on said active payline associated with one of said reels which is directly between two non-convertible flanking symbols generated on said active payline associated with two of said reels, do not change said non-convertible symbol to one of said non-convertible flanking symbols; and (g) if said convertible symbol is generated on said active payline associated with one of said reels which is not directly between two non-convertible flanking symbols generated on said active payline associated with two of said reels, do not change said convertible symbol.

2. The gaming device of claim 1, wherein a plurality of said symbols are convertible.

3. The gaming device of claim 2, wherein at least one of said non-convertible flanking symbols is associated with one of said convertible symbols.

4. The gaming device of claim 3, wherein said processor is configured to cause said generated convertible symbol to change to said associated non-convertible flanking symbol and cause a display of said change if at least one of the non-convertible flanking symbols which the convertible symbol is directly between is one of said non-convertible flanking symbols.

5. The gaming device of claim 2, wherein said processor is configured to change a plurality of said convertible symbols and cause a display of said changes if said convertible symbols are generated on a plurality of said reels and said convertible symbols are each between two non-convertible flanking symbols.

6. The gaming device of claim 1, wherein a plurality of said symbols are non-convertible.

7. The gaming device of claim 1, wherein a plurality of said symbols are non-convertible flanking symbols.

8. A gaming device comprising:

a primary game operable upon a wager by a player;

a plurality of reels in said primary game;

a plurality of symbols on said reels, wherein said plurality of symbols include at least four symbols which each function as a flanking symbol or as a convertible symbol, wherein upon a first play of the primary game, two of said symbols function as flanking symbols and one of said symbols functions as the convertible symbol, upon a second play of the primary game, said convertible symbol of said first play of the primary game functions as the flanking symbol and one of said flanking symbols of said first play of the primary game functions as the convertible symbol, for each play of the primary game, any of the symbols which function as flanking symbols do not function as convertible symbols for that play of the primary game and for each play of the primary game, any of the symbols which function as flanking symbols are visually distinct from any of the symbols which function as convertible symbols; and a processor configured for each play of the primary game to: cause a generation of at least one of said symbols on each of the reels, change each convertible symbol to one of said flanking symbols and cause a display of said change if said convertible symbol is generated on an active payline associated with one of said reels which is directly between two flanking symbols generated on said active payline associated with two of said reels, and provide the player an award based on any winning combination of symbols on the reels.

9. A gaming device comprising:

a display device configured to display a plurality of reels and a plurality of symbols on said reels, wherein at least one of said symbols is a non-convertible flanking symbol, at least one of said symbols is a convertible symbol, at least one of said symbols is a non-convertible symbol, and at least two of said symbols are flanking-convertible symbols, wherein upon a first play of a game, one of said flanking-convertible symbols functions as a convertible symbol and one of said flanking-convertible symbols functions as a non-convertible flanking symbol, and upon a second play of the game, said flanking-convertible symbol which functioned as the convertible symbol for said first play of the game functions as the non-convertible flanking symbol for the second play of the game, said flanking-convertible symbol which functioned as the non-convertible flanking symbol for said first play of the game functions as the convertible symbol for the second play of the game and for each play of the game, said flanking-convertible symbols, any non-convertible symbol, any of the symbols which function as non-convertible flanking symbols, and any of the symbols which function as convertible symbols are visually distinct from each other; and a processor configured to operate with the display device to: cause a generation and display of at least one of said symbols on each of the reels, change each convertible symbol to one of said non-convertible flanking symbols and cause a display of said change if said convertible symbol is on an active payline associated with one of said reels which is directly between two non-convertible flanking symbols generated on said active payline associated with two of said reels, and provide a player an award based on any winning combination of symbols on the reels, wherein if said non-convertible symbol is generated on said active payline associated with one of said reels which is directly between two non-convertible flanking symbols generated on said active payline associated with two of said reels, said non-convertible symbol does not change to one of said non-convertible flanking symbols, and if said convertible symbol is generated on said active payline associated with one of said reels which is not directly between two non-convertible flanking symbols generated on said active payline associated with two of said reels, said convertible symbol does not change.

10. The gaming device of claim 9, wherein the processor is configured to enable the player to designate said flanking-convertible symbol as a non-convertible flanking symbol, a convertible symbol or both.

11. A gaming device comprising:

a display device configured to display a plurality of reels and a plurality of symbols on said reels, wherein at least two of said symbols are non-convertible flanking symbols, at least one of said symbols is a convertible symbol, at least one of said symbols is a non-convertible symbol and a plurality of said symbols are flanking-convertible symbols, wherein said at least two non-convertible flanking symbols, said at least one convertible symbol, said at least one non-convertible symbol and said plurality of flanking-convertible symbols are visually distinct from one another; and a processor configured to operate with the display device, for a single play of a game, to:

(a) cause a generation and display of one of said non-convertible flanking symbols on an active payline associated with a first of said reels;

(b) cause a generation and display of one of said flanking-convertible symbols on said active payline associated with a second of said reels;

(c) cause a generation and display of one of said flanking-convertible symbols on said active payline associated with a third of said reels;

(d) cause a generation and display of one of said non-convertible flanking symbols on said active payline associated with a fourth of said reels, wherein said second reel and said third reel are directly between said first and fourth reels;

(e) enable a player to designate each of said flanking-convertible symbols on said second reel and said third reel as either one of said non-convertible flanking symbols or as one of said convertible symbols;

(f) if the player designates said flanking-convertible symbol on said second reel as one of said convertible symbols, designate said convertible symbol on said third reel as one of said non-convertible flanking symbols, change said designated flanking-convertible symbol on said second reel to one of said non-convertible flanking symbols, and cause a display of said change;

(g) if the player designates said flanking-convertible symbol on said third reel as a convertible symbol, designate said convertible symbol on said second reel as one of said non-convertible flanking symbols, change said designated flanking-convertible symbol on said third reel to one of said non-convertible flanking symbols, and cause a display of said change;

(h) do not change said non-convertible to one of said non-convertible flanking symbols if said non-convertible symbol is generated on said active payline associated with one of said reels which is directly between two of said non-convertible flanking symbols generated on said active payline associated with two of said reels;

(i) change said convertible symbol to one of said non-convertible flanking symbols and cause a display of said change if said convertible symbol is directly between two non-convertible flanking symbols generated on said active payline associated with two adjacent reels;

(j) do not change said convertible symbol if said convertible symbol is generated on said active payline associated with one of said reels which is not directly between two non-convertible flanking symbols generated on said active payline associated with two of said reels; and (k) provide the player an award based on any winning combination of symbols on the reels.

12. The gaming device of claim 11, wherein the processor is configured to enable the player to designate said flanking-convertible symbol as non-convertible flanking symbol, a convertible symbol or both.

13. The gaming device of claim 11, wherein a plurality of said symbols are convertible.

14. The gaming device of claim 11, wherein a plurality of said symbols are non-convertible.

15. The gaming device of claim 11, wherein a plurality of said symbols are non-convertible flanking symbols.

16. A gaming device comprising:

a display device configured to display a plurality of reels and a plurality of symbols on said reels, wherein at least two of said symbols are non-convertible flanking symbols, at least one of said symbols is a convertible symbol, at least one of said symbols is a flanking-convertible symbols, and at least one of said symbols is a non-convertible symbol, wherein said flanking-convertible symbol is associated with at least one of said non-convertible flanking symbols and wherein said at least two non-convertible flanking symbols, said at least one convertible symbol, said at least one flanking-convertible symbol and said at least one non-convertible symbol are visually distinct from one another; and a processor configured to operate with the display device, for a single play of a game, to:

(a) cause a generation and display of at least one of said symbols on each of the reels;

(b) if said flanking-convertible symbol is generated on an active payline associated with one of said reels which is directly between two of said non-convertible flanking symbols generated on said active payline associated with two of said reels, and said generated flanking-convertible symbol is associated with at least one of said non-convertible flanking symbols which said flanking-convertible symbol is directly between, designate said flanking-convertible symbol as one of said convertible symbols, change said designated convertible symbol to one of said non-convertible flanking symbols, and cause a display of said change;

(c) if said flanking-convertible symbol is generated on the active payline associated with one of said reels which is directly between two of said non-convertible flanking symbols generated on said active payline associated with two of said reels and said generated flanking-convertible symbol is not associated with at least one of said non-convertible flanking symbols which said flanking-convertible symbol is directly between, do not designate said flanking-convertible symbol to one of said convertible symbols;

(d) if said flanking-convertible symbol is generated on the active payline associated with one of said reels which directly flanks one of the at least one convertible symbols generated on said active payline associated with one of said reels, and said convertible symbol is additionally flanked by one of said non-convertible flanking symbols, designate said flanking-convertible symbol as one of said non-convertible flanking symbols, change said convertible symbol to one of said non-convertible flanking symbols, and cause a display of said change; and (e) provide a player an award based on any winning combination of symbols on the reels, wherein if said non-convertible symbol is generated on said active payline associated with one of said reels which is directly between two non-convertible flanking symbols generated on said active payline associated with two of said reels, said non-convertible symbol does not change to one of said non-convertible flanking symbols, and if said convertible symbol is generated on said active payline associated with one of said reels which is not directly between two non-convertible flanking symbols generated on said active payline associated with two of said reels, said convertible symbol does not change.

17. The gaming device of claim 16, wherein a plurality of said symbols are convertible.

18. The gaming device of claim 16, wherein a plurality of said symbols are non-convertible.

19. The gaming device of claim 16, wherein a plurality of said symbols are non-convertible flanking symbols.

20. A gaming device comprising:

a display device configured to display a plurality of reels and a plurality of symbols on said reels, wherein at least two of said symbols are non-convertible flanking symbols, a plurality of said symbols are convertible symbols, at least one of said symbols is a flanking-convertible symbol, and at least one of said symbols is a non-convertible symbol and wherein said at least two non-convertible flanking symbols, said plurality of convertible symbols, said at least one flanking-convertible symbol and said at least one non-convertible symbol are visually distinct from one another; and a processor configured to operate with the display device, for a single play of a game, to:

(a) cause a generation and display of one of said non-convertible flanking symbols on an active payline associated with a first of said reels;

(b) cause a generation and display of one of said flanking-convertible symbols on said active payline associated with a second of said reels;

(c) cause a generation and display of one of said flanking-convertible symbols on said active payline associated with a third of said reels;

(d) cause a generation and display of one of said non-convertible flanking symbols on said active payline associated with a fourth of said reels, wherein said second reel and said third reel are directly between said first and fourth reels;

(e) designate said flanking-convertible symbol on said third reel as one of said non-convertible flanking symbols if said flanking-convertible symbol on said second reel is designated as one of said convertible symbols;

(f) designate said flanking-convertible symbol on said second reel as one of said non-convertible flanking symbols if said flanking-convertible symbol on said third reel is designated as one of said convertible symbols;

(g) change any designated convertible symbol to one of said non-convertible flanking symbols and cause a display of said change if said convertible symbol is directly between two non-convertible flanking symbols generated on said active payline associated with two adjacent reels; and (h) provide a player an award based on any winning combination of symbols on the reels, wherein if said non-convertible symbol is generated on said active payline associated with one of said reels which is directly between two non-convertible flanking symbols generated on said active payline associated with two of said reels, said non-convertible symbol does not change to one of said non-convertible flanking symbols, and if said convertible symbol is generated on said active payline associated with one of said reels which is not directly between two non-convertible flanking symbols generated on said active payline associated with two of said reels, said convertible symbol does not change.

21. The gaming device of claim 20, wherein a plurality of said symbols are non-convertible.

22. The gaming device of claim 20, wherein a plurality of said symbols are non-convertible flanking symbols.

23. The gaming device of claim 20, wherein said convertible symbols on said second reel and said third reel are different symbols.

24. A gaming device comprising:

a display device configured to display a plurality of reels and a plurality of symbols on said reels, wherein at least two of said symbols are non-convertible flanking symbols, at least one of said symbols is a convertible symbol, at least one of said symbols is a flanking-convertible symbol, and at least one of said symbols is a non-convertible symbol and wherein said at least two non-convertible flanking symbols, said at least one convertible symbol, said at least one flanking-convertible symbol and said at least one non-convertible symbol are visually distinct from one another; and a processor configured to operate with the display device, for a single play of a game, to:

(a) cause a generation and display of at least one of said symbols on each of the reels wherein the number of generated non-convertible flanking symbols is based on the wager by a player;

(b) if said flanking-convertible symbol is generated on an active payline associated with one of said reels which is directly between two of said non-convertible flanking symbols generated on said active payline associated with two of said reels, designate said flanking-convertible symbol as one of said convertible symbols, change said designated convertible symbol to one of said non-convertible flanking symbols, and cause a display of said change;

(c) if said flanking-convertible symbol is generated on the active payline associated with one of said reels which directly flanks one of the at least one convertible symbols generated on said active payline associated with one of said reels, and said convertible symbol is additionally flanked by one of said non-convertible flanking symbols, designate said flanking-convertible symbol as one of said non-convertible flanking symbols, change said convertible symbol to one of said non-convertible flanking symbols, and cause a display of said change;

(d) provide the player an award based on any winning combination of symbols on the reels, wherein if said non-convertible symbol is generated on said active payline associated with one of said reels which is directly between two non-convertible flanking symbols generated on said active payline associated with two of said reels, said non-convertible symbol does not change to one of said non-convertible flanking symbols, and if said convertible symbol is generated on said active payline associated with one of said reels which is not directly between two non-convertible flanking symbols generated on said active payline associated with two of said reels, said convertible symbol does not change.

25. A method of operating a gaming device, for a single play of a game, said method comprising the steps of:

(a) generating and displaying a flanking symbol on an active payline associated with a first reel, a flanking-convertible symbol on the active payline associated with a second reel, a flanking-convertible symbol on the active payline associated with a third reel, a flanking-convertible symbol on the active payline associated with a fourth reel, a flanking symbol on the active payline associated with a fifth reel, wherein said flanking symbols and said flanking-convertible symbols are visually distinct from each other;

(b) designating the flanking-convertible symbols on the second and fourth reel as flanking symbols and said flanking-convertible symbol on the third reel as a convertible symbol;

(c) changing said designated convertible symbol on the third reel to one of said flanking symbols and causing a display of said change if said flanking-convertible symbols on the second and fourth reel are designated as flanking symbols and said flanking-convertible symbol on the third reel is designated as a convertible symbol;

(d) providing a player any award based on any winning combination of said displayed symbols on the active payline associated with the reels;

(e) designating the flanking-convertible symbols on the second, third and fourth reels as convertible symbols;

(f) changing said designated convertible symbols on the second, third and fourth reels to one of said flanking symbols, and causing a display of said change; and (g) providing the player any award based on any winning combination of said displayed symbols on the active payline associated with the reels.

26. The method of claim 25, wherein the player is enabled to designate said flanking-convertible symbols on the second and fourth reel as flanking symbols and said flanking-convertible symbol on the third reel as a convertible symbol.

27. The method of claim 25, wherein the player is enabled to designate the flanking-convertible symbols on the second, third and fourth reels as convertible symbols.

28. The method of claim 25, wherein the player is enabled to designate said flanking-convertible symbols on the second and fourth reel as flanking symbols and said flanking-convertible symbol on the third reel as a convertible symbol and subsequently to designate the flanking-convertible symbols on the second, third and fourth reels as convertible symbols.

29. The method of claim 25, which is provided to the player through a data network.

30. The method of claim 29, wherein the data network is an internet.

31. A method of operating a gaming device, said method comprising the steps of:

(a) generating a plurality of symbols on an active payline associated with a plurality of reels for one game play, wherein said plurality of symbols include at least four symbols which are each adapted to function as a flanking symbol or as a convertible symbol, wherein two of said symbols function as flanking symbols and one of said symbols functions as said convertible symbol, wherein any of the symbols which function as flanking symbols are visually distinct from any of the symbols which function as convertible symbols;

(b) changing said convertible symbol to one of said flanking symbols and causing a display of said change if said generated convertible symbol is directly between two generated flanking symbols;

(c) providing a player an award based on any winning combination of symbols on the reels; and (d) repeating steps (a) to (c) for a plurality of game plays, wherein for at least one subsequent game play, any convertible symbol of said previous game play which was not directly between two generated flanking symbols functions as said flanking symbol and one of said flanking symbols of said previous game play functions as said convertible symbol and for each game play, any of the symbols which function as flanking symbols do not function as convertible symbols for that game play.

32. The method of claim 31, which is provided to the player through a data network.

33. The method of claim 32, wherein the data network is an internet.

* * * * *

UNITED STATES PATENT AND TRADEMARK OFFICE

CERTIFICATE OF CORRECTION

PATENT NO. : 7,503,847 B2
APPLICATION NO. : 10/657366
DATED : March 17, 2009
INVENTOR(S) : Anthony J. Baerlocher It is certified that error appears in the above-identified patent and that said Letters Patent is hereby corrected as shown below:

On Title page item [56]:

U.S. Patent Documents, change "6,514,141 B1 2/2003 Kaminkow et al." to --6,514,141 B1 2/2004 Kaminkow et al.--.

U.S. Patent Documents, change "6,565,433 B1 5/2003 Baerlocher et al." to --6,565,433 B1 5/2003 Baerlocher--.

Signed and Sealed this

Thirtieth Day of June, 2009

John Doll

JOHN DOLL
*Acting Director of the United States Patent and Trademark Office*